US008590241B2

(12) United States Patent
Koch

(10) Patent No.: US 8,590,241 B2
(45) Date of Patent: Nov. 26, 2013

(54) COMPRESSIVE FORCE TRANSMITTING CONNECTION ELEMENT

(75) Inventor: Georg Koch, Kirchhundem (DE)

(73) Assignee: TebeTec AG, Finsterhennen (CH)

( * ) Notice: Subject to any disclaimer, the term of this patent is extended or adjusted under 35 U.S.C. 154(b) by 0 days.

(21) Appl. No.: 13/301,620

(22) Filed: Nov. 21, 2011

(65) Prior Publication Data

US 2012/0186176 A1 Jul. 26, 2012

(30) Foreign Application Priority Data

Nov. 19, 2010 (EP) ..... 10191914
Jul. 12, 2011 (EP) ..... 11173639
Oct. 11, 2011 (EP) ..... 11184629

(51) Int. Cl.
*E04B 1/686* (2006.01)
*E04F 15/14* (2006.01)

(52) U.S. Cl.
USPC ..... 52/396.05; 52/394; 52/395; 52/396.04

(58) Field of Classification Search
USPC ..... 52/250, 393, 394, 395, 396.04, 396.05, 52/396.08, 402, 403.1, 404.1
See application file for complete search history.

(56) References Cited

U.S. PATENT DOCUMENTS 8,132,388 B2 * 3/2012 Nagy et al. ..... 52/745.05
2004/0216404 A1 * 11/2004 Black ..... 52/250

FOREIGN PATENT DOCUMENTS

| | | |
|---|---|---|
| CH | 678 076 | 7/1991 |
| DE | 94 13 502 | 12/1994 |
| DE | 297 14 081 | 9/1997 |
| DE | 200 08 570 | 9/2001 |
| EP | 0 219 792 | 4/1987 |
| EP | 0 338 972 | 10/1989 |
| EP | 1 154 086 | 11/2001 |
| EP | 1 154086 | 1/2003 |
| EP | 2 151 531 | 2/2010 |
| EP | 2 241 690 | 10/2010 |
| WO | WO 2010/046841 | 4/2010 |

* cited by examiner

*Primary Examiner* — James Buckle, Jr.

(74) *Attorney, Agent, or Firm* — Cozen O'Connor

(57) ABSTRACT

A force transmitting connection element having an insulation body limited by two oppositely located support surfaces which are at a distance corresponding to a height H of the force transmitting connection. A first support surface faces a first cast structural component part and has a length $L_1$ and a width $B_1$. A second support surface limiting the insulation body faces a second cast structural component part and has a length $L_2$ and a width $B_2$. A longitudinal center axis runs through a center of the insulation body. A element penetrates the insulation body. An element for transmitting transverse force projects beyond the compressive force transmitting connection element in direction of the first cast structural component part and a ratio between transmissible compressive force and transmissible transverse force is between 1.5:1 and 15:1 and a distance $L_K$ is less than $(B_1+B_2)/6$.

18 Claims, 6 Drawing Sheets

Prior Art

Prior Art

COMPRESSIVE FORCE TRANSMITTING CONNECTION ELEMENT

BACKGROUND OF THE INVENTION

1. Field of the Invention

The present invention is directed to a compressive force transmitting connection element suitable for compressive force transmitting connection of a first cast structural component part to a second cast structural component part. More precisely, a connection element of this kind generically comprises:

an insulation body (31) for thermal separation of the first cast structural component part (13, 29) and second cast structural component part (15) situated above and below the compressive force transmitting connection element (17), this insulation body (31) limited by two oppositely located support surfaces (39, 41) which are at a distance from one another corresponding to the height H of the compressive force transmitting connection element (17), wherein the first support surface (39) limiting the insulation body (31) faces the first cast structural component part (13, 29) and has a length $L_1$ and a width $B_1$, and wherein the second support surface (41) limiting the insulation body (31) faces the second cast structural component part (15) and has a length $L_2$ and a width $B_2$, a longitudinal center axis (A) running through the center of the insulation body (31) between the oppositely located support surfaces (39, 41), at least one compression element (33) that penetrates the insulation body (31) from the first support surface (39) thereof to the second support surface (41) thereof and has horizontal compression surfaces which face the first cast structural component part (13, 29) on one side and/or the second cast structural component part (15) on the other side, and an element for transmitting transverse force.

2. Description of the Related Art

A heat insulating masonry unit is known from EP 2 151 531 A2. The compression elements of this heat insulating masonry unit are constructed from cement mortar, for example, and its heat insulating body preferably comprises glass foam or rock foam. In this instance, a structured surface to which grit is possibly applied serves for transmitting transverse force. A masonry unit of this kind is no doubt satisfactory with respect to heat insulation and with respect to transmission of compressive force, but the technical features suggested in the above-cited document are not persuasive with a view to the transmission of transverse force.

EP 0 338 972 A1 discloses a non-generic cantilever slab connection element in which the two oppositely located contact surfaces for the structural component parts to be thermally insulated lie on the same plane relative to one another. A cantilever slab connection element of this kind is provided for the connection of balconies, as an example of cantilever slabs, to an adjacent floor slab. The known cantilever slab connection element comprises a rectangular insulation body traversed by compression rods which are located one above the other in pairs and which run through the insulation body horizontally. In order to prevent rusting of these compression rods, which are preferably not produced from stainless steel for cost reasons, they are each enclosed by sleeves, and a hardenable material, e.g., a polymer-enhanced mortar, is injected between the sleeves and the compression rods.

The subject matter of the non-generic WO 2010/046 841 A1 is a connection element for building connections in which an insulating body is traversed by reinforcement bars extending diagonally at an angle between 1° and 89° to the vertical which are connected in pairs to a reinforcing plate. Accordingly, the known connection element appears to have exclusively transverse force transmitting elements, since the reinforcing plate is not suitable as a compression element either with respect to its construction or with respect to its inclusion within the above-cited document.

A construction element for heat insulation in masonry is also known from DE 94 13 502 U1. While vertical supporting columns of cement mortar which are connected to one another by webs are disclosed as compression elements, the material for the heat insulating bodies comprises rigid foam polystyrene. However, there is no mention made within this document of possible elements for transmitting transverse force.

EP 1 154 086 A2, suggests a heat insulating element for heat flux decoupling between wall part and floor slab, does mention elements for transmitting transverse force. The known heat insulating element can have column-shaped supporting elements having an insulating element filling the intermediate spaces between these supporting elements. Anchor projections in the form of dowels arranged flat on the outer sides of the suggested heat insulating element serve as elements for transmitting transverse force and tensile force. This type of known heat insulating element may be feasible with respect to its heat insulation and can perhaps also contain light transverse forces which can occur when a known constructional member of this kind is transported; however, this document does not suggest an approach for a convincing solution to the problem of containing larger transverse forces such as those arising, for example, from systematic earth pressure or wind stabilization on a possible order of magnitude of at least greater than 10 kN/m.

EP 2 241 690 A2 discloses a connection element for the foundation of concrete structural component parts in which steel reinforced concrete columns and a concrete crossbeam supported by these columns are inserted in an insulation body for the connection of floors which is to be anchored therein. In a possible embodiment form, transverse force transmitting steel bars project downward out of the concrete columns. However, this document does not suggest the construction of transverse force transmitting elements on both sides, much less an arrangement of such transverse force transmitting elements in relation to the compressive force transmitting elements which are also provided.

Corresponding to known constructions for heat insulation, FIG. 1 shows the customary mounting of a concrete wall (15) on a concrete floor slab (13) with reference to a conventional concrete construction (11). The concrete floor slab (13) and the concrete wall (15) are connected to one another monolithically by frictional engagement and without insulation. It can be seen that the heat insulation (5, 7) is provided on the outer side of and underneath the concrete floor slab (13) and also on the outer side of the concrete wall (15). For structural reasons, the heat insulation (7) arranged under the concrete floor slab (13) must be compression-resistant, age-resistant and rot-resistant depending on the degree of loading.

As a rule, the required compressive strength of the heat insulation (7) under the floor slab must be greater than 150 $kN/m^2$. The materials commonly used for this purpose are XPS panels, foam glass blocks or foam glass gravel. These are high-quality, compression-resistant materials. High compressive strengths result in lower heat insulating values at lambda>40 mW/mK. The comparatively high heat conductivity at constant thermal insulating power results in greater layer thicknesses and, therefore, higher materials consumption than comparable solutions with interior insulations. Further, the ecology of the building is negatively affected by the high consumption of resource-intensive materials (embodied energy). Nevertheless, for want of alternatives, this type of construction is used for low-energy and passive-house concepts.

The concrete construction (11) according to FIG. 2 is monolithic, frictionally engaging and only unsatisfactorily insulated. The heat insulation (5, 9) is arranged on the outer side of the outside wall (15) and is arranged so as to rest upon the concrete floor slab (13). The use of interior insulation (9) offers enormous cost savings as well as a reduction in the embodied energy required; however, this construction has the obvious disadvantage that a cold bridge exists between the concrete floor slab (13) and the concrete wall (15).

In FIGS. 3 and 4, a non-compression-resistant heat insulation (9) is arranged below and/or above a concrete (basement) ceiling (29) such as is applied, for example, for unheated basement rooms. A concrete construction (11) of this kind is likewise monolithic, frictionally engaging and only unsatisfactorily insulated. There is also a cold bridge between the concrete wall (15) and the concrete (basement) ceiling (29) in this solution. Systems of this kind are not suitable for low-energy houses or passive houses because of the local energy loss and the risk of mold growth (structural cold bridge).

SUMMARY OF THE INVENTION

Proceeding from the prior art evaluated above in the cited documents and shown in FIGS. 1 to 4, an object of the present invention is a connection element for two cast structural component parts which are connected to one another, i.e., preferably a concrete floor or concrete ceiling on the one hand and concrete wall on the other hand, which substantially eliminates the structural cold bridges commonly occurring in concrete constructions and which is equally able to absorb large compressive forces and large transverse forces at the same time. A further goal is to propose a solution by which concrete constructions can meet new and future energy standards at low financial and technical expenditure. A further goal consists in a concrete construction having optimal flux of force and optimized heat insulation at the same time.

The above-stated object is met by a compressive force transmitting connection element (17) for the compressive force transmitting connection of a first cast structural component part (13, 29) to a second cast structural component part (15), at least having:

an insulation body (31) for thermal separation of the first cast structural component part (13, 29) and second cast structural component part (15) which are situated above and below the compressive force transmitting connection element (17), this insulation body (31) being limited by two oppositely located support surfaces (39, 41) which are at a distance from one another corresponding to the height H of the compressive force transmitting connection element (17), wherein the first support surface (39) limiting the insulation body (31) faces the first cast structural component part (13, 29) and has a length $L_1$ and a width $B_1$, and wherein the second support surface (41) limiting the insulation body (31) faces the second cast structural component part (15) and has a length $L_2$ and a width $B_2$, a longitudinal center axis (A) running through the center of the insulation body (31) between the oppositely located support surfaces (39, 41), at least one compression element (33) which penetrates the insulation body (31) from the first support surface (39) thereof to the second support surface (41) thereof and has horizontal compression surfaces which face the first cast structural component part (13, 29) on one side and/or the second cast structural component part (15) on the other side, elements for transmitting transverse force, characterized in that the elements for transmitting transverse force project beyond the compressive force transmitting connection element (17) in direction of the first cast structural component part (13, 29) on one side and project beyond the compressive force transmitting connection element (17) in direction of the second cast structural component part (15) on the other side, the ratio between transmissible compressive force and transmissible transverse force measured in transmissible force units is in a range between 1.5:1 and 15:1, a distance $L_K$ is defined between the resultant compressive force as resultant force (K) of the transmissible compressive forces and the longitudinal center axis (A), where:

$$L_K \leq (B_1+B_2)/6.$$

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
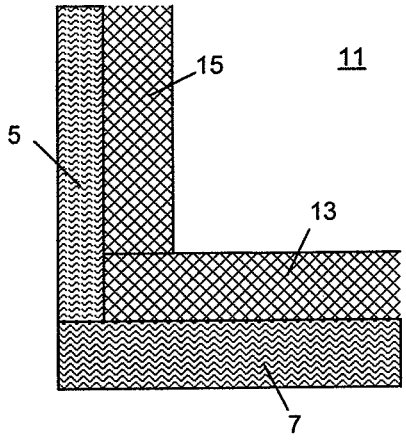
FIGS. 1-4 depict prior art constructions.

Without being limiting to these embodiment forms, the first cast structural component part (13, 29) is preferably an element selected from the list comprising concrete floor slab and concrete ceiling slab, while the second cast structural component part (15) is preferably a concrete wall. Accordingly, the connection element (17) suggested herein is to be positioned so as to be sandwiched, e.g., between a concrete slab and a concrete wall; it is completely immaterial within the meaning of the invention which of the two concrete parts, namely, concrete slab and concrete wall, is situated above the suggested connection element (17) and which of them is situated below the connection element (17). In the preferred embodiment forms of concrete floor slab, concrete ceiling slab and concrete wall, the elements for transmitting transverse force which project beyond the compressive force transmitting connection element (17) in direction of the first cast structural component part (13, 29) on one side and which project beyond the compressive force transmitting connection element (17) in direction of the second cast structural component part (15) on the other side can now be connected by frictional engagement to the concrete structural component parts (13, 15, 29) in that they are cast integral with the compressive force transmitting connection element (17) on one or both sides. Accordingly, in the installed state the connection element (17) according to the invention is arranged between a concrete floor slab (13) and a concrete wall (15) or between a concrete ceiling slab (29) and a concrete wall (15) so as to ensure an efficient thermal separation between the two concrete parts situated above and below the compressive force transmitting connection element (17).

The insulation body (31) provided for the thermal separation of the first cast structural component part (13, 29) from the second cast structural component part (15) preferably has a compressive strength of at least 50 kN/m$^2$ that allows a particularly preferred freshly poured concrete structure having a height of at least 2 meters to rest directly upon the uncovered insulation body (31). It is particularly preferred embodiment the insulation body (31) has a compressive strength of possibly greater than 50 or 100 kN/m$^2$, more preferably greater than 200 kN/m$^2$, particularly preferably greater than 300 kN/m$^2$ or even greater than 500 kN/m$^2$, determined respectively at a compressive strain of 2%. In a particularly advantageous manner, the insulation body (31) has a stiffness modulus of greater than 80 N/mm$^2$, preferably greater than 100 N/mm$^2$ and particularly preferably greater than 150 N/mm$^2$. This has the advantage that the at least one compression element (33), or the constructed plurality of compression elements (33), is supported by the surrounding material of the insulation body (31) and exposed to only especially small shear forces if any. Without limiting exclusively thereto, the materials available for the insulation body (31) are foam glass, expanded hard polystyrene foam (EPS), and XPS.

A particularly preferred material for producing the insulation body is foam glass. Foam glass has a compressive strength of greater than 200 kN/m$^2$ and a stiffness modulus of greater than 80 N/mm$^2$.

Because of the exposed position of the connection element (17), the insulation body (31) is fashioned from a material which is advisably waterproof and particularly preferably impervious to water vapor, preferably age-resistant and resistant to pests and rot. These requirements are also met to an outstanding degree by the foam glass which is particularly preferred by the inventors.

According to one embodiment of the invention, the ratio (a)/(b) between (a) transmissible compressive force, chiefly influenced by the compression elements (33), and (b) transmissible transverse force, chiefly influenced by the transverse force transmitting elements and the static integration thereof within the compressive force transmitting connection element (17) proposed herein, measured in transmissible force units, respectively, is in a range of 1.5:1 to 15:1, preferably greater than 2:1, and particularly preferably greater than 5:1. According to the invention, the connection element (17) is capable of transmitting more, particularly preferably in accordance with the preferred constructional variants substantially more, compressive force than transverse force; with respect to the transmissible compressive force, upper range limits can preferably be at least 500 kN, particularly preferably at least 800 kN, and most preferably at least 1300 kN per compression element (33) for the proposed compressive force transmitting connection element (17) with corresponding numbers for the transmissible transverse force corresponding to the ratios which are preferably used in accordance with the above statements. The force units that can be transmitted through an element can be determined by loading the elements to failure.

The connection element (17) according to the invention has

- a height H as distance between the two support surfaces (39, 41) limiting the insulation body (31),
- a length $L_1$ and a width $B_1$ of the first support surface (39),
- a length $L_2$ and a width $B_2$ of the second support surface (41), and
- a longitudinal center axis (A) running through the center of the insulation body (31) between the oppositely located support surfaces (39, 41).

Therefore, the connection element (17) according to the invention can be constructed, e.g., as a body having a polygonal cross section (e.g., a hexagonal body—particularly in the form of an equilateral hexagon, an octagonal body—particularly in the form of a regular octagon) and having two first and second flat sides which are located opposite one another and particularly preferably parallel to one another and which correspond to the two oppositely located support surfaces (39, 41) limiting the insulation body (31) or which, in the possible case of pressure distributing elements (51) projecting out over the support surfaces (39, 41), are situated parallel to the two support surfaces (39, 41). However, the connection element (17) according to one embodiment of the invention is advantageously constructed as a rectangular body having side lengths $L=L_1=L_2$, $B=B_1=B_2$, H. This has the advantage that the lateral surfaces of the connection element (17) can be flush with, e.g., the concrete walls (15) resting upon them.

According to one embodiment of the invention, the longitudinal center axis (A) runs through the center of the insulation body (31) between the oppositely located support surfaces (39, 41) and, when the latter are constructed in a particularly preferable manner so as to be parallel, extends within a plane which is oriented parallel to the oppositely located support surfaces (39, 41). Within this plane, the position of the longitudinal center axis (A) for every cross section through the connection element (17) according to the invention is fixed by the points of intersection of this plane with the respective straight connecting line extending through point $S_1$ of the first support surface (39) bisecting the broad sides and through point $S_2$ of the second support surface (41) bisecting the broad sides (see also FIG. 9).

When the connection element (17) is constructed as a rectangular body having side lengths $L=L_1=L_2$, $B=B_1=B_2$, H, the longitudinal center axis (A) extends parallel to the four side edges through the center at half of the height H/2 at a distance from the two lateral surfaces of the connection element (17), respectively, of B/2.

According to the invention, a distance $L_K$ between the resultant compressive force as resultant force (K) of the transmissible compressive forces and the longitudinal center axis (A)—also known in technical jargon as the system axis—is defined by $$L_K \leq (B_1+B_2)/6.$$

A feature of this kind can be implemented in that the at least one compression element (33) extends centrically through the longitudinal center axis (A) or, when there is a plurality of compression elements (33), these compression elements (33) are arranged centrically through and/or symmetric to the longitudinal center axis (A) (symmetrical arrangement). In case of an asymmetrical arrangement of the compression elements (33) outside the longitudinal center axis (A) of the connection element (17), for example, for purposes of optimizing the flux of force, the arrangement is carried out according to the invention in such a way that the resultant compressive force is located off center by a maximum of $(B_1+B_2)/6$, i.e., by one third of the cross-sectional width of the connection element (17) when the proposed connection element (17) is constructed as a rectangular body.

In a particularly preferred manner, a distance $L_K$ between the resultant compressive force as resultant force (K) of the transmissible compressive forces and the longitudinal center axis (A) is defined by $L_K=0$. This means that when there is a plurality of compression elements (33), these compression elements (33) are arranged symmetrically with respect to the longitudinal center axis (A).

In a particularly preferred manner when there is exactly one compression element (33) penetrating the insulation body (31), this compression element (33) extends centrically through the longitudinal center axis (A);

when there is a plurality of compression elements (33) penetrating the insulation body (31), all of the compression elements (33) extend centrically through the longitudinal center axis (A).

According to the invention, the insulation body (31) is penetrated at least by exactly one compression element (33). In such a case, for purposes of the required absorption of compressive forces and shear forces, this compression element (33), if only one such compression element (33) is provided, has a greater extension in the longitudinal axis and transverse axis of the connection element (17) than would be the case if the insulation body (31) were penetrated by a plurality of compression elements (33) constructed so as to be spaced apart from one another. In this connection, it is preferable that the cross-sectional area of the compression element (33) when there is exactly one compression element (33) penetrating the insulation body (31), or the sum of the cross-sectional areas of the compression elements (33) when there is a plurality of compression elements (33) penetrating the insulation body (31), accounts for 0.3% to 62.5%, particularly preferably 3% to 25%, and better yet 3% to 15%, of either the first support surface (39) limiting the insulation body (31) or the second support surface (41) limiting the insulation body (31) or particularly preferably of the smaller of the two support surfaces (39, 41). When the cross-sectional area of the one compression element (33) or of the plurality of compression elements (33) varies over the length thereof, the minimum cross-sectional area determined at the position of the respective compression element (33) where the cross-sectional area thereof reaches the lowest possible value is the quantity to be taken into account.

The at least one compression element (33) according to the invention that penetrates the insulation body (31) from the first support surface (39) thereof to the second support surface (41) thereof is advantageously produced from steel, stainless steel, fiber reinforced plastic, concrete, fiber reinforced concrete, or another compression-resistant, i.e., substantially non-compressible, material. Especially preferred by the inventors are concrete, fiber reinforced concrete and fiber reinforced plastic because in this case the at least one compression element (33) also guarantees good thermal insulation between the two support surfaces (39, 41) limiting the insulation body (31). It is also conceivable and, depending on the installation situation, even particularly advantageous that when there is a plurality of compression elements (33) penetrating the insulation body (31) these compression elements (33) are made of different materials. For example, it is conceivable and is deemed as a particularly excellent embodiment form of the invention when compression elements (33) positioned along the longitudinal center axis (A) and which have an increased cross-sectional area are made of, or comprise, fiber reinforced concrete, while compression elements (33) which are moved outward from the longitudinal center axis (A) and have a reduced cross-sectional area are made of, or comprise, steel.

Within the framework of a first preferred constructional variant, when there is exactly one compression element (33) penetrating the insulation body (31), the cross-sectional area of the compression element (33) which is made of steel, or when there is a plurality of compression elements (33) penetrating the insulation body (31), the sum of the cross-sectional areas of the compression elements (33) which are made of steel accounts for 0.3% to 6.0%, particularly preferably 0.6% to 4.5%, of either the first support surface (39) limiting the insulation body (31) or the second support surface (41) limiting the insulation body (31) or particularly preferably of the smaller of the two support surfaces (39, 41).

Within the framework of a first second preferred constructional variant, when there is exactly one compression element (33) penetrating the insulation body (31), the cross-sectional area of the compression element (33) which is made of concrete, particularly fiber reinforced concrete, or when there is a plurality of compression elements (33) penetrating the insulation body (31), the sum of the cross-sectional areas of the compression elements (33) which are made of concrete, particularly fiber reinforced concrete, accounts for 2% to 50%, particularly preferably 3% to 25%, and better yet 4% to 15%, of either the first support surface (39) limiting the insulation body (31) or the second support surface (41) limiting the insulation body (31) or particularly preferably of the smaller of the two support surfaces (39, 41).

The compression element (33) is advisably inserted into the insulation body (31) to be free from slippage. This has the advantage that the at least one compression element (33) obtains additional stability through the surrounding insulation body (31).

Figure 11:
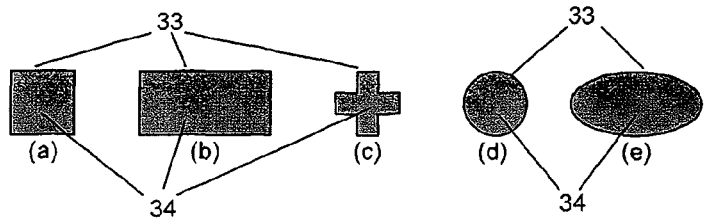
FIGS. 11*a*-11*e* are compression elements.

According to the embodiment examples shown in FIG. 11, a-e, the at least one compression element (33) can have at its ends adjoining the compression surfaces fundamentally different bases (34) such as square (a), rectangular (b), cross profile (c), round (d), oval, or elliptical (e), etc.

Figure 12:
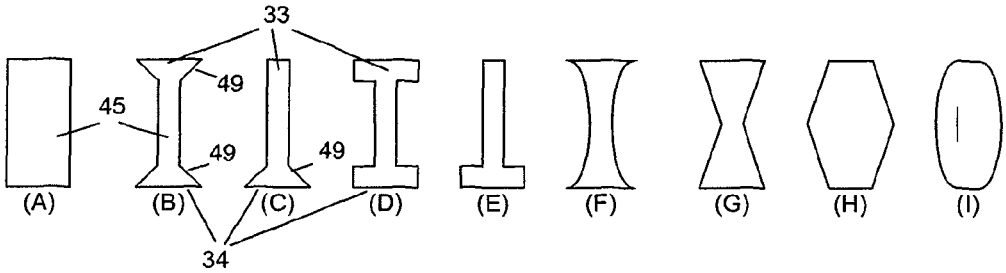
FIGS. 12A-12I are compression elements.

The compression elements (33) according to FIG. 12 can likewise have different body shapes (45) in longitudinal section. The body (45) of the compression elements (33) between the bases (34) thereof at the two ends can be cylindrical (A), reduced in diameter relative to one (C, E) or both bases (B, D, F, G), or can be curved inward (F) or outward (I).

The embodiment example (F) according to FIG. 12 in which the cross section of the at least one compression element (33) is reduced in diameter toward the center.

According to the invention, the at least one compression element (33) has a horizontal compression surface facing the first cast structural component part (13, 29) on one side and/or a horizontal compression surface facing the second cast structural component part (15) on the other side. This means that the compression surfaces, as direct contact surfaces between the first and/or second cast structural component part (13, 15, 29) on one side and the at least one compression element (33) on the other side, are not curved but rather are constructed so as to be flat and parallel to the two support surfaces (39, 41) and, if required, are lightly textured, e.g., have a granular and/or herringbone pattern. It is particularly preferable when at least one pressure distributing element (51) is formed as a horizontal compression surface of the kind defined above at least at one end face of the at least one compression element (33).

Within the framework of a particularly preferred embodiment form, the horizontal compression surface of the at least one compression element (33) projects beyond at least one—particularly preferably beyond both—of the two support surfaces (39, 41) of the insulation body (31) by a maximum length between 0 mm and 10 mm, more preferably between 0 mm and 5 mm, or more restrictedly between 0 mm and 3 mm, and in a particularly preferable manner the horizontal compression surfaces and the two support surfaces (39, 41) of the insulation body (31) are constructed in a planar manner, i.e., so as to lie in a common plane. Through implementation of this preferred feature, possible shrinkage processes of the integrally cast concrete structural component parts (13, 15, 29) are hindered as little as possible because, otherwise, unwanted tensions would result in the cured concrete. In a manner crucial to the invention, the construction of the compression surfaces as horizontal termination of the at least one compression element (33) serves to deflect structural loads resting on the compression elements (33) vertically downward without additional horizontal forces being built up, which would lead to stresses in the concrete or in structural members situated above the connection element (17) proposed herein and/or in the inventive connection element (17) itself.

Insofar as at least one pressure distributing element (51), e.g., in the form of a pressure distributing plate, is constructed as horizontal compression surface at least at one end face of the at least one compression element (33), it is particularly preferable when the area of the pressure distributing element (51) when exactly one pressure distributing element (51) is formed or the total area of pressure distributing elements (51) when a plurality of pressure distributing elements (51) is formed accounts for 3% to 100%, preferably 7% to 100%, and particularly preferably 14% to 100%, of either the first support surface (39) limiting the insulation body (31) or the second support surface (41) limiting the insulation body (31) or particularly preferably the smaller area of the two support surfaces (39, 41). While the at least one pressure distributing element (51) is a determining factor for the height of the freshly poured concrete construction above the connection element (17) according to the invention and is a determining factor for the freedom in the choice of material for the insulation body (31), the compression elements (33) chiefly ensure that the structural component part resting on the connection element (17) transmits the resultant compressive force proceeding from the building after the concrete has cured.

Besides the pressure distributing plates suggested in the preceding paragraph as preferred constructional variants of the optional pressure distributing elements (51), the following examples of a pressure distributing element (51) of this kind are also conceivable and, moreover, are considered preferable:

- rods, particularly comprising metal or plastic-encased metal, which extend in a straight line and run parallel to the support surfaces (39, 41) limiting the insulation body (31),
- rods, particularly comprising metal or plastic-encased metal, which are curved or are bent helically and extend in a plane parallel to the support surfaces (39, 41) limiting the insulation body (31),
- grates, particularly comprising metal, plastic-encased metal, fiber reinforced plastics, or plastics, extending in a plane parallel to the support surfaces (39, 41) limiting the insulation body (31).

According to one embodiment of the invention, the elements for transmitting transverse force project beyond the compressive force transmitting connection element (17) in direction of the first cast structural component part (13, 29) on one side and project beyond the compressive force transmitting connection element (17) in direction of the second cast structural component part (15) on the other side.

In this respect, it is preferable when the elements for transmitting transverse force project by a length in a range from 2 to 100 cm, more restrictedly in a range from 4 to 70 cm, and still more restrictedly in a range from 4 to 50 cm. In this way, a frictionally engaging connection of the elements for transmitting transverse force to the possible reinforcement in the middle of the first cast structural component part (13, 29) and second cast structural component part (15), respectively, can be made possible in a particularly satisfactory manner.

Rod-shaped elements (e.g., straight or curved reinforcement bars) and plate-shaped members as well as diverse other profile constructions can be used for the elements for transmitting transverse force. The elements for transmitting transverse force preferably comprise at least one transverse force transmitting element (35) which runs through the compressive force transmitting connection element (17) in a straight line and continuously. In a particularly preferred manner, the elements for transmitting transverse force are primarily or exclusively formed by rod-shaped, continuous transverse force transmitting elements (35) of this kind which are curved or extend in a straight line. By "continuously" is meant within the meaning of the present application that the transverse force transmitting element (35) passes through the connection element (17) without material gaps. The transverse force transmitting element (35) can comprise a plurality of individual pieces which have been glued, welded or otherwise permanently connected to one another before insertion into the connection element (17). In a particularly preferred manner within the meaning of the present application, the transverse force transmitting element (35) runs through the connection element (17) in one piece; in other words, the transverse force transmitting element (35) is formed of an individual workpiece which is not composite, but rather extends uninterruptedly.

The at least one transverse force transmitting element (35) is preferably rod-shaped and runs through the connection element (17) in a straight line. Within the framework of a further developed preferred embodiment form, the elements for transmitting transverse force comprise at least one pair of two rod-shaped transverse force transmitting elements (35).

Within the framework of the above-mentioned embodiment form and also in general, it is preferable when the elements for transmitting transverse force and particularly when the rod-shaped transverse force transmitting elements (35) forming the at least one pair are angled at least in some areas outside the insulation body (31). The angled areas are also designated as extensions (60) adjoining the center portion (59). In particular, an angling of the extensions (60) has the advantage that the elements provided according to one embodiment of the invention for transmitting transverse forces also ensure transmission of tensile forces so that a construction of this kind allows a particularly stable building construction, particularly concrete building constructions (11), which makes it possible to connect the first cast structural component part (13, 29) to the second cast structural component part (15) in such a way that the transverse force can also be carried off in diametrically opposite directions.

Further, within the framework of the embodiment form having transverse force transmitting elements (35) which are constructed in pairs, it is preferable when the transverse force transmitting elements (35) forming the at least one pair are connected to one another at least once at a distance from one another outside the insulation body (31).

In one embodiment of the present invention, the at least one compression element (33) is connected to the elements for transmitting transverse force by frictional engagement. This preferred embodiment form can be combined unconditionally with all of the embodiment forms and constructional variants suggested herein, which is, of course, also applicable within the meaning of the invention in general and in cases not mentioned separately.

The frictionally engaging connection between the at least one compression element (33) and the elements for transmitting transverse force is preferably formed as a connection selected from the list comprising glue joint, weld joint, brazed joint, integrally cast joint, and joint by enclosure over at least a portion of the circumference. Gluing, welding and brazing can be carried out only in a pointwise or sectionwise manner; however, it is particularly preferable that this type of frictionally engaging connection is carried out in that the at least one compression element (33) is glued, welded or brazed to the elements for transmitting transverse force along the entire contact surface therebetween. Another preferred form of the frictionally engaging connection between the at least one compression element (33) and the elements for transmitting transverse force consists in that the at least one compression element (33) is enclosed over at least part of its circumference by the elements for transmitting transverse force, or in a particularly preferred manner in that the elements for transmitting transverse force is enclosed over at least part of its circumference by the at least one compression element (33). Combinations of the types of connections mentioned above are also possible and indeed are deemed as preferred variants within the meaning of the present invention.

The elements for transmitting transverse force, particularly in its embodiment as a continuous transverse force transmitting element (35), can be enclosed over at least part of its circumference by the at least one compression element (33), which means that at least one eighth of the circumference of the transverse force transmitting element (35) is directly adjacent to and preferably frictionally connected to and/or enclosed by the compression element (33) over at least 25% of the length of the compression element (33) measured between the two support surfaces (39, 41) of the insulation body (31). In a particularly preferable manner, the transverse force transmitting element (35) is enclosed over at least one fourth or, better yet, at least one half of its circumference by the at least one compression element (33), which means within the meaning of the present application that at least one half of the circumference of the transverse force transmitting element (35) is directly adjacent to and preferably frictionally connected to and/or enclosed by the compression element (33) over at least 25% of the length of the compression element (33) measured between the two support surfaces (39, 41) of the insulation body (31). It is particularly preferable that the transverse force transmitting element (35) is enclosed over its full circumference by the at least one compression element (33), which means within the meaning of the present application that the transverse force transmitting element (35) is formed within this compression element (33) along the full length of the compression element (33) and is thus connected to the compression element (33) particularly preferably by frictional engagement and material bonding.

In the preferred case of a plurality of transverse force transmitting elements (35) within the proposed connection element (17), it is particularly preferred when the transverse force transmitting elements (35) are connected at least for the most part in pairs to at least one compression element (33) by frictional engagement. In a possible embodiment form, a pair of two preferably rod-shaped transverse force transmitting elements (35) is enclosed over at least part of its circumference, particularly preferably even completely, by a compression element (33).

Further, within the framework of embodiment forms having transverse force transmitting elements (35) formed in pairs, it is preferable when the transverse force transmitting elements (35) forming a pair are constructed so as to intersect in the middle inside the at least one compression element (33). In so doing, it is conceivable in particular that when there is a plurality of compression elements (33) penetrating the insulation body (31) these compression elements (33) are:

- partially traversed by a pair of at least two, preferably exactly two, rod-shaped transverse force transmitting elements (35) which are angled at least in some areas and which are constructed so as to intersect inside the respective compression elements (33);
- partially traversed by a pair of at least two, preferably exactly two, rod-shaped transverse force transmitting elements (35) which are constructed in a straight line along their entire length.

With respect to the transverse force transmitting elements (35) which are constructed in a rod-shaped manner so as to intersect, it is preferable when these two transverse force transmitting elements (35) are directly frictionally connected to one another at the point of intersection, possibly by gluing or welding. It is equally preferable when the two intersecting transverse force transmitting elements (35) are indirectly frictionally connected to one another in that they are frictionally connected, respectively, to at least one common compression element (33). It is also conceivable and equally preferable when the two transverse force transmitting elements (35) are fixed at the point of intersection exclusively by the material of the compression element (33) enclosing the two transverse force transmitting elements (35) over at least part of their circumference. In all of the cases described above and without limiting to possible embodiment forms, the transverse force transmitting elements (35) are each preferably made from a material selected from the list comprising steel, structural steel, stainless steel, and fiber reinforced plastic (GRP=glass fiber reinforced plastic, CRP=carbon fiber reinforced plastic), particular preference being given to structural steel and stainless steel.

Figure 2:
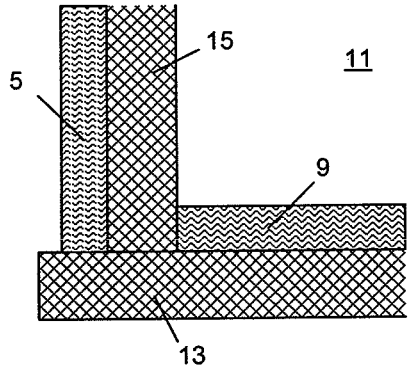
Prior Art Figure 2
Figure 3:
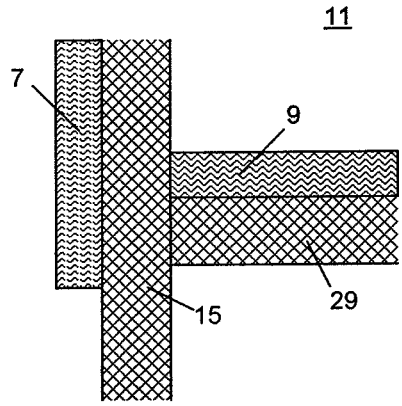
Figure 4:
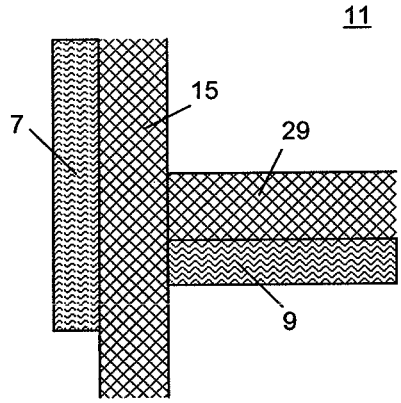
Prior Art Figure 4
Figure 5:
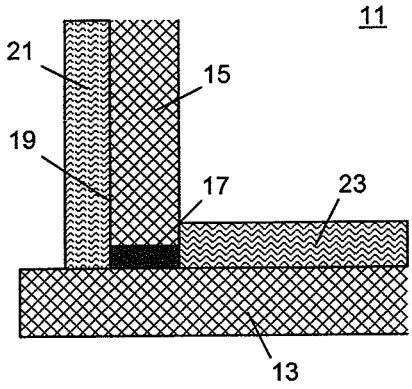
FIGS. 5-7 depict construction techniques according to the present invention.

In the embodiment example according to the invention which is illustrated in FIG. 5 and which shows a construction situation comparable to that shown in FIG. 2, a concrete wall (15)—as an example of a vertical concrete structural component part (15)—is to be arranged on a concrete floor slab (13) arranged on soil and which serves as an example of a horizontal concrete structural component part, a compressive force transmitting connection element (17) according to the invention being positioned therebetween. The connection element (17) positioned in this way presents a rectangular body having a low thermal conductivity coefficient of less than 60 mW/mK in the present case, which is capable of thermally separating the one concrete part (15) from an adjoining concrete part (13) within the concrete construction (11) shown in the drawing. An exterior insulation (21) corresponding to the prior art is arranged at the outer side (19) of the concrete wall (15) and also covers the outer side of the connection element (17) for the most part and preferably completely. In the present case, the concrete floor slab (13) projects beyond the concrete wall (15) by a certain amount and the exterior insulation (21) leads up to the concrete floor slab (13). An interior insulation (23) is provided on the concrete floor slab (13) in the interior area of the house. Obviously, the concrete construction (11) shown in this instance is completely thermally separated from the environment. Therefore, the concrete construction (11) according to the invention shown in FIG. 5 corresponds to the thermally optimal construction according to FIG. 1 because there is also no structural cold bridge in this case.

Figure 6:
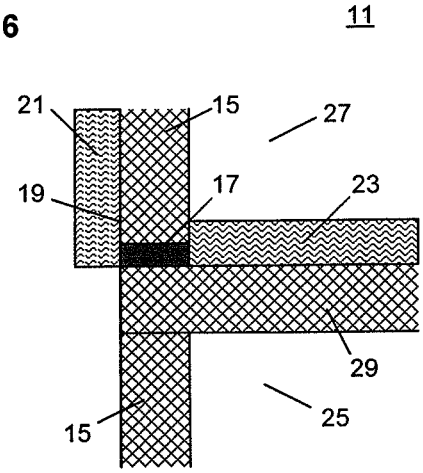

The embodiment example according to the invention illustrated in FIG. 6 is a concrete construction (11) in which a basement (25) is separated from a story (27) located above it by a concrete basement ceiling (29). Like the concrete construction (11) according to FIG. 5, the rising concrete wall (15) is mounted at the level of the story (27) on a compressive force transmitting connection element (17) according to the invention, and the interior insulation (23) is arranged on the basement ceiling (29). The exterior insulation (21) also covers the outer side of the connection element (17) for the most part and preferably completely so that the story (27) is also mostly thermally insulated from the basement (25) and the environment in this construction.

Figure 7:
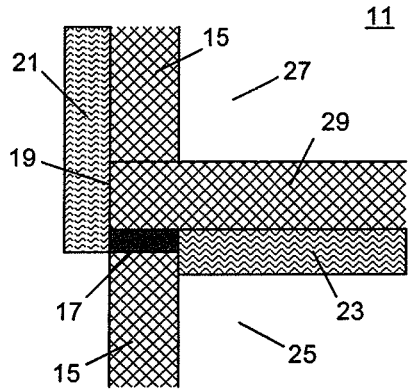

The concrete construction (11) depicted in FIG. 7 differs from the concrete construction (11) in FIG. 6 in that the basement ceiling (29) in this case rests on a compressive force transmitting connection element (17) according to the invention. Correspondingly, the interior insulation (23) is arranged below rather than above the basement ceiling (29). It can again be seen that the basement (25) is thermally insulated from the building construction above it by the connection element (17) and the interior insulation (23).

Figure 8:
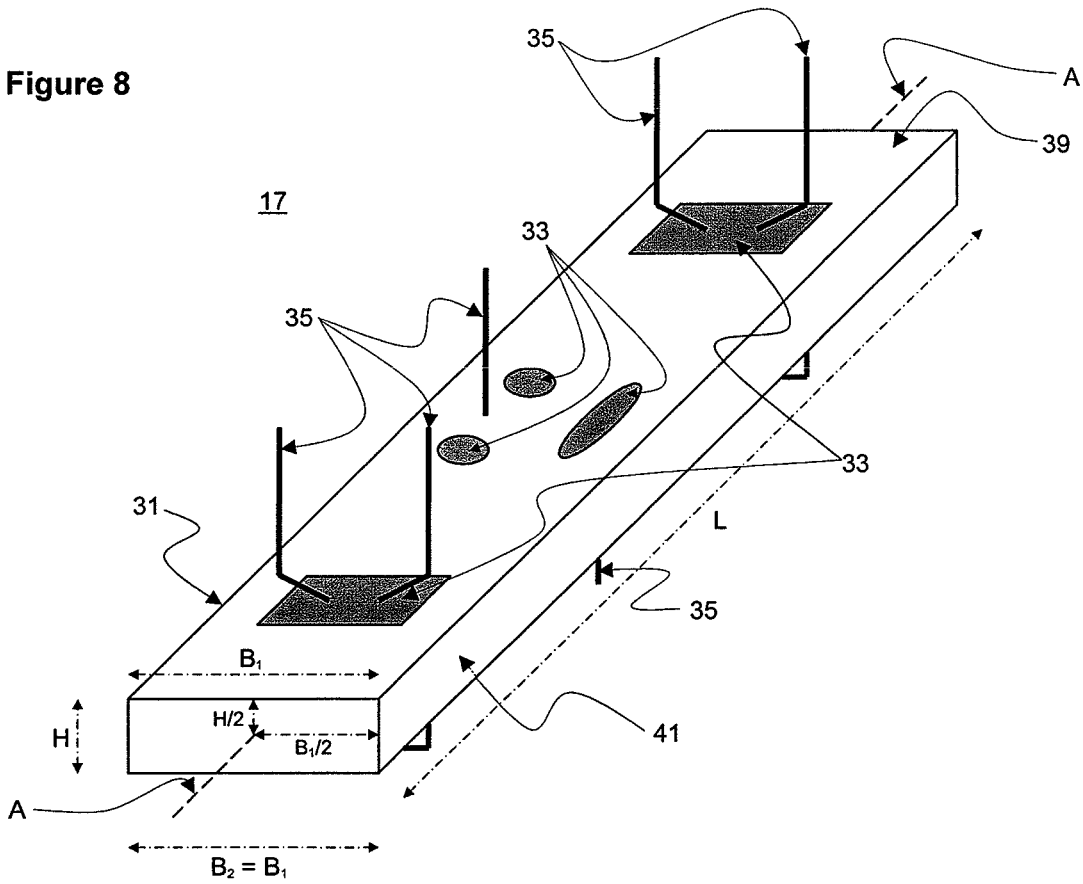
FIG. 8 depicts a compressive force transmitting connection element.

A compressive force transmitting connection element (17) according to the invention is shown in FIG. 8 unconnected to any installation situations in a characteristic, but not limiting and to this extent freely selected, embodiment form such as can be used for the above-described concrete constructions according to FIGS. 5 to 7. The compressive force transmitting connection element (17) has in this instance a rectangular insulation body (31) which is fabricated, e.g., from XPS in the present case and which is limited on the top by the first plane support surface (39) and on the bottom by the second support surface (41) which is oriented in a planar manner and parallel to the first support surface (39). In the installed state of the connection element (17), these support surfaces (39, 41) face the two cast structural component parts (13, 15, 29), not shown in FIG. 8. The two support surfaces (39, 41) have an identical length $L=L_1=L_2$ and an identical width $B=B_1=B_2$ and are a distance from one another corresponding to the height H of the compressive force transmitting connection element (17). The half-height H/2 and half-width $B_1/2$ of the insulation body (31) are indicated at the end face of the insulation body (31) to illustrate the course of the longitudinal center axis (A).

In the present instance, the insulation body (31) is penetrated by two rectangular compression elements (33), indicated in hatching, which are made of concrete in the present case, by two cylindrical compression elements (33), likewise indicated in hatching, which are made of fiber reinforced plastic in this case, and by an elliptical compression element (33), indicated by hatching, which is likewise made of fiber reinforced plastic in this case. All of the compression elements (33) extend between the support surfaces (39, 41) and have at their ends, respectively, horizontal compression surfaces which terminate flush with the support surfaces (39, 41) so as not to hinder the shrinkage process of adjoining freshly cast concrete during installation.

The two rectangular compression elements (33) which sit in the middle on the longitudinal center axis (A) of the connection element (17) are each traversed by a pair of two rod-shaped transverse force transmitting elements (35) which are constructed so as to intersect in the middle inside the respective compression element (33) and which project out of the first support surface (39) and out of the second support surface (41), respectively, by a length of 35 cm in the present case. In both cases, the two transverse force transmitting elements (35) are connected to one another once at a distance from one another outside the insulation body (31), in the present case underneath the connection element (17).

The two cylindrical compression elements (33) arranged asymmetrically on only one side with respect to the longitudinal center axis (A) of the connection element (17) are not traversed by any transverse force transmitting elements (35) in this case. At the same time, however, the elliptical compression element (33) is provided on the other side of the longitudinal center axis (A). A transverse force transmitting element (35) which is constructed corresponding to FIG. 13 (*a*) projects beyond the first support surface (39) by a length of 35 cm in the present instance, penetrates the insulation body (31) in the area between the two cylindrical compression elements (33), is angled outside the first support surface (39) in direction of the elliptical compression element (33) in which the transverse force transmitting element (35) is inserted laterally and still within the insulation body (31), and then continues downward at an angle outside the second support surface (41). The transverse force transmitting element (35) pierces the second support surface (41) so as to be enclosed by the material of the elliptical compression element (33) and projects further out of the second support surface (41) by 35 cm in this case.

Figure 9:
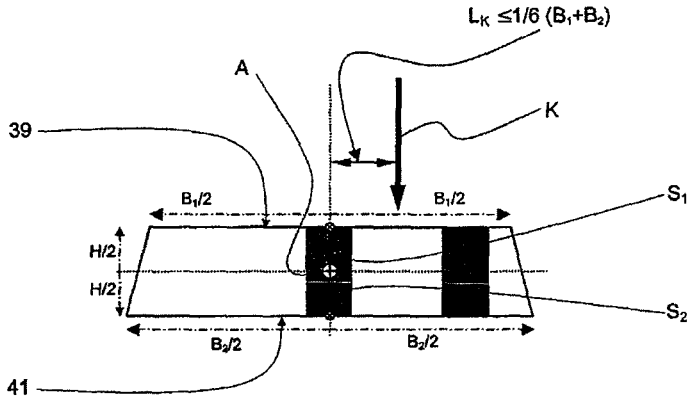
FIG. 9 is a compressive force transmitting connection element.

FIG. 9 shows the cross section of a compressive force transmitting connection element (17) according to the invention in which width $B_1$ of the first support surface (39) is less than width $B_2$ of the second support surface (41) so that the insulation body (31) is trapezoidal rather than rectangular in contrast to the situation depicted in FIG. 8. To determine the position of the longitudinal center axis (A), a straight connecting line is first defined through point $S_1$ bisecting the broad sides on the first support surface (39) and through point $S_2$ bisecting the broad sides on the second support surface (41). The straight line determined in this way then intersects the height bisector of the insulation body (31) at the position of the longitudinal center axis (A) for the relevant cross section. The shapes of two compression elements (33—not designated by reference numbers in the drawing) and the position of the resultant force (K) whose distance from the position of the longitudinal center axis (A) meets the condition $L_K \leq (B_1+B_2)/6$ according to the invention are indicated by hatching in FIG. 9.

Figure 10:
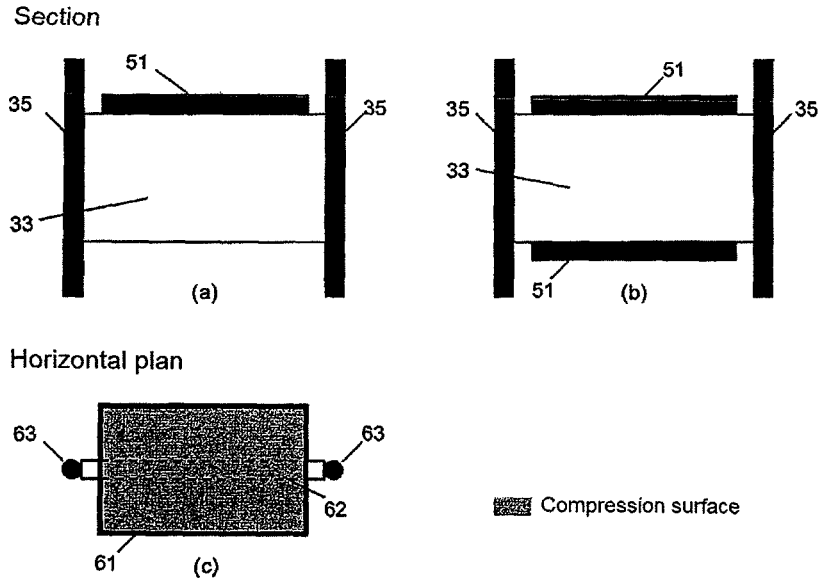
FIGS. 10*a*-10*c* are plate shaped compression elements.

Two possible embodiments of plate-shaped compression elements (33) to be oriented in the manner of an upended rectangle, each having a pair of two rod-shaped transverse force transmitting elements (35) extending in a straight line, are shown in section in FIG. 10. The transverse force transmitting elements (35) limit the plate-shaped compression elements (33) on the outer side and are connected thereto by frictional engagement. In FIG. 10 (*a*) a pressure distributing element (51) is formed only at the upper end face of the compression element (33). In FIG. 10 (*b*), pressure distributing elements (51) are formed at both end faces, both at the top and at the bottom in this case. FIG. 10 (*c*) shows the arrangements from FIGS. 10 (*a*) and (*b*) in a horizontal plan view (viewed from above).

Figure 13:
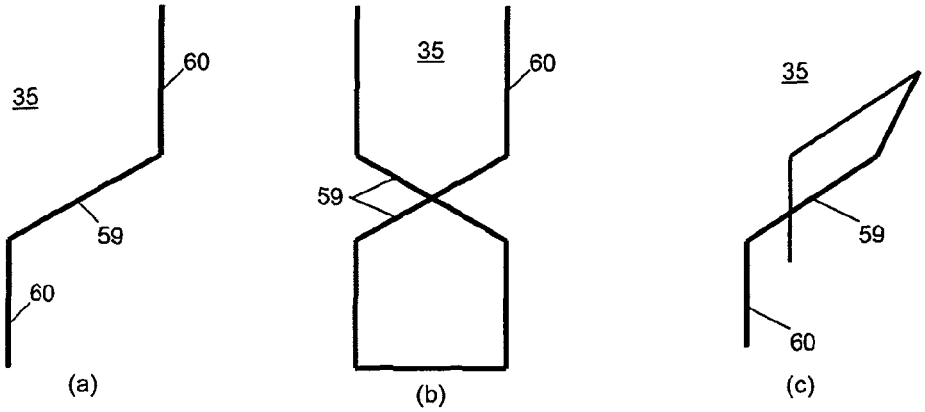
FIGS. 13*a*-13*c* are transverse force transmitting elements.

FIG. 13 shows three different embodiment forms for the transverse force transmitting elements (35) frictionally connected to the at least one compression element (33) penetrating the insulation body (31) from the first support surface (39) thereof to the second support surface (41) thereof. The transverse force transmitting elements (35) are preferably formed by rods of structural steel or stainless steel. According to a first embodiment form shown in FIG. 13*a*, a transverse force transmitting element (35) of this kind comprises a center portion (59) which is angled at least in some areas outside the insulation body (31), not shown in FIG. 13*a*. The angled areas are designated in this instance as extensions (60). According to FIG. 13*b*, the transverse force transmitting element (35) can also comprise two rods that intersect in the respective center portion (59) thereof and lengthened at one end by the extensions (60) projecting at an angle. In the installed state, the point of intersection of the rods is located approximately in the middle of the insulation body (31). The other ends are lengthened in such a way that they are connected to one another at a distance from one another outside the insulation body (31) in the installed state. In another advisable embodiment form for the transverse force transmitting elements (35) according to FIG. 13*c*, the transverse force transmitting element (35) has the shape of an angled "U". The transverse force transmitting elements (35) are preferably installed in the insulation body (31) in such a way that the center portion (59) which is angled relative to the extensions (60) extends approximately transverse to the longitudinal center axis (A) of the connection element (17).

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A compressive force transmitting connection element for a compressive force transmitting connection of a first cast structural component part to a second cast structural component part, comprising:

an insulation body for thermal separation of the first cast structural component part and second cast structural component part arranged vertically above and below the compressive force transmitting connection element, the insulation body limited by oppositely located first and second support surfaces which are at a distance from one another substantially corresponding to a height of the compressive force transmitting connection element, the first support surface limiting the insulation body faces the first cast structural component part and has a first length and a first width B1; and the second support surface limiting the insulation body faces the second cast structural component part and has a second length and a second width B2;

a longitudinal center axis (A) that's runs through a center of the insulation body between the oppositely located first and second support surfaces;

at least one compression element that penetrates the insulation body from the first support surface to the second support surface and has respective horizontal compression surfaces that face the first cast structural component part and the second cast structural component part;

at least one element for transmitting transverse force that projects beyond the compressive force transmitting connection element in a direction of the first cast structural component part on one side and projects beyond the compressive force transmitting connection element in direction of the second cast structural component part on an other side;

a ratio between transmissible compressive force and transmissible transverse force measured in transmissible force units is in a range between 1.5:1 and 15:1; and a distance LK is defined between a resultant compressive force as resultant force (K) of the transmissible compressive forces and the longitudinal center axis (A), where:

$$LK \leq (B1+B2)/6.$$

2. The compressive force transmitting connection element according to claim 1, wherein the ratio between transmissible compressive force and transmissible transverse force measured in transmissible force units is greater than 2:1.

3. The compressive force transmitting connection element according to claim 1, wherein the distance LK between the resultant compressive force as resultant force (K) of the transmissible compressive forces and the longitudinal center axis (A) is defined by LK=0.

4. The compressive force transmitting connection element according to claim 1, wherein when there is exactly one compression element penetrating the insulation body, the one compression element extends centrically through the longitudinal center axis (A); and when there is a plurality of compression elements penetrating the insulation body, each of the plural compression elements extend centrically through the longitudinal center axis (A).

5. The compressive force transmitting connection element according to claim 1, wherein the first cast structural component part is one of a concrete floor slab and a concrete ceiling slab.

6. The compressive force transmitting connection element according to claim 5, wherein the second cast structural component part is a concrete wall.

7. The compressive force transmitting connection element according to claim 6, wherein a compressive strength of the insulation body is greater than 200 kN/m2.

8. The compressive force transmitting connection element according to claim 1, wherein the element for transmitting transverse force comprises at least one transverse force transmitting element that runs through the compressive force transmitting connection element continuously in a straight line.

9. The compressive force transmitting connection element according to claim 1, wherein the element for transmitting transverse force comprises an angled portion external to the insulation body.

10. The compressive force transmitting connection element according to claim 1, wherein the element for transmitting transverse force comprises at least one pair of two rod-shaped transverse force transmitting elements connected to one another at least once at a distance from one another outside the insulation body.

11. The compressive force transmitting connection element according to claim 1, wherein the at least one compression element is connected by frictional engagement to the element for transmitting transverse force.

12. The compressive force transmitting connection element according to claim 11, wherein the frictionally engaging connection between the at least one compression element and the element for transmitting transverse force is formed as a connection selected from the list consisting of a glue joint, a weld joint, a brazed joint, an integrally cast joint, and a joint by enclosure over at least a portion of the circumference.

13. The compressive force transmitting connection element according to claim 1, wherein a cross-sectional area of the compression element when there is exactly one compression element penetrating the insulation body or a sum of the cross-sectional areas of the compression elements when there is a plurality of compression elements penetrating the insulation body accounts for 0.3% to 62.5% of one of the first support surface limiting the insulation body and the second support surface.

14. The compressive force transmitting connection element according to claim 1, wherein a cross-sectional area of the compression element made of steel when there is exactly one compression element penetrating the insulation body, or a sum of the cross-sectional areas of the compression elements made of steel when there is a plurality of compression elements penetrating the insulation body, accounts for 0.3% to 4.5% of at least one of the first support surface limiting the insulation body and the second support surface.

15. The compressive force transmitting connection element according to claim 13, wherein a cross-sectional area of the compression element made of concrete when there is exactly one compression element penetrating the insulation body, or a sum of the cross-sectional areas of the compression elements made of concrete when there is a plurality of compression elements penetrating the insulation body, accounts for 3% to 15% of at least one of the first support surface limiting the insulation body and the second support surface.

16. The compressive force transmitting connection element according to claim 1, wherein at least one pressure distributing element is formed as a horizontal compression surface at least at one end face of the at least one compression element.

17. The compressive force transmitting connection element according to claim 16, wherein the horizontal compression surface of the at least one compression element projects beyond at least one of the two support surfaces of the insulation body by a length between 0 mm and 10 mm.

18. The compressive force transmitting connection element according to claim 1, wherein the ratio between transmissible compressive force and transmissible transverse force measured in transmissible force units is greater than 5:1.

* * * * *